US006347736B1

(12) United States Patent
Lackey et al.

(10) Patent No.: US 6,347,736 B1
(45) Date of Patent: Feb. 19, 2002

(54) NESTABLE MAILBOX AND METHOD

(75) Inventors: Robert W. Lackey, Hickory; Robert C. Beckman, Vale, both of NC (US); Gregory A. Harris, Tacoma, WA (US)

(73) Assignee: R.W.L. Corporation, Hickory, NC (US)

( * ) Notice: Subject to any disclaimer, the term of this patent is extended or adjusted under 35 U.S.C. 154(b) by 0 days.

(21) Appl. No.: 09/486,160

(22) PCT Filed: Aug. 24, 1998

(86) PCT No.: PCT/US98/17505

§ 371 Date: Feb. 22, 2000

§ 102(e) Date: Feb. 22, 2000

(87) PCT Pub. No.: WO99/10255

PCT Pub. Date: Mar. 4, 1999

Related U.S. Application Data

(62) Division of application No. 08/917,645, filed on Aug. 22, 1997, now Pat. No. 5,988,495.

(51) Int. Cl.[7] ..... B65D 91/00

(52) U.S. Cl. ..... 232/17; 232/29; 232/33

(58) Field of Search ..... 232/17, 45, 29, 232/33, 38, 1 C; 206/518, 515

(56) References Cited

U.S. PATENT DOCUMENTS

| | | | | |
|---|---|---|---|---|
| 1,992,640 | A | * | 2/1935 | Steen |
| 2,781,964 | A | * | 2/1957 | Ledgerwood |
| 3,181,782 | A | * | 5/1965 | Monroe |
| 4,181,250 | A | * | 1/1980 | Withrow |
| 4,600,143 | A | * | 7/1986 | Harlow, Jr. et al. |
| 4,923,114 | A | * | 5/1990 | Fiske, Jr. |
| 5,009,366 | A | * | 4/1991 | Van Druff, Jr. et al. |
| 5,083,703 | A | * | 1/1992 | Blyakharov |
| 5,425,501 | A | * | 6/1995 | Wesorick |
| 5,575,422 | A | * | 11/1996 | Peterman |

* cited by examiner

*Primary Examiner*—B. Dayoan
*Assistant Examiner*—William L. Miller
(74) *Attorney, Agent, or Firm*—J. Herbert O'Toole; Nexsen Pruet Jacobs & Pollard, LLC

(57) ABSTRACT

A nestable mailbox (10) having a tapered body (12) with an open first end (24) and a second end (30). The tapering of the body (12) is such that the first end (24) circumscribes a greater surface area than that circumscribed by the second end (30). A door (26) for the mailbox (10) is connected to the body (12) at the first end (24). The mailbox can then be nested with other like mailboxes by inserting the second end (30) of one mailbox into the first end (24) of another mailbox. The door of each mailbox in the nested arrangement can point downwardly frontwardly or downwardly rearwardly. The nestable mailbox may additionally, if desired, carry another door (76) at the second end (30).

20 Claims, 16 Drawing Sheets

NESTABLE MAILBOX AND METHOD

This a divisional application of U.S. Ser. No. 08/917,645, filed Aug. 22, 1997, now U.S. Pat. No. 5,988,495.

BACKGROUND OF THE INVENTION

1. Field of the Invention

The present invention relates generally to mailboxes. More particularly, the present invention relates to mailboxes that reduce the amount of packaging material required to ship and store a plurality of mailboxes, thereby also reducing the overall volume of cargo containing such mailboxes, as well as the space required to display the mailboxes in a retail setting.

2. Description of Related Art

Mailboxes are commonly sold in a variety of outlets ranging from craft shops to department stores and home centers. When mailboxes are shipped to a retailer, they are usually boxed individually for display on the retailer's shelf. While mailboxes come in many sizes and shapes, they are often at least twenty inches long, eight inches high, and seven inches wide. With their bulky size, mailboxes rapidly take up cargo space during shipping and then use up valuable display space on retailers, shelves.

The prior art contains numerous examples of mailboxes having telescopic components. For example, U.S. Pat. No. 1,992,640 to Steen discloses a telescopic mailbox that will extend to receive unusually long packages. Similarly, U.S. Pat. No. 2,781,964 to Ledgerwood discloses a mailbox having an inner sleeve that extends outward to reach a mail carrier sitting behind the wheel of an automobile. Finally, U.S. Pat. Nos. 4,600,143 and 5,009,366 to Harlow, Jr. et al. and van Druff, Jr. et al. respectively, show mailbox inserts for assisting in removing mail from the box.

However, the prior art still requires individual packaging of mailboxes. Accordingly, there remains room for improvement and variation within the art of mailboxes.

SUMMARY OF THE INVENTION

One object of the invention is to provide a mailbox that can be nested with a like mailbox for minimizing shipping and display space requirements.

These and other objects are accomplished by a nestable mailbox comprising a body having a pair of spaced side walls, a top connected to the side walls, and a bottom panel connected to the side walls opposite the top, the body having a first end defining a first surface area and a second end defining a second surface area. The body is tapered from the first end to the second end such that the first surface area is larger than the second surface area, enabling the second end to be received in another mailbox constructed substantially identically to the nestable mailbox.

The foregoing objects are also accomplished by a method of packaging a plurality of mailboxes, comprising the steps of providing each mailbox with a body having a pair of spaced side walls, a top connected to the side walls, and a bottom panel connected to the side walls opposite the top, the body having an open first end defining a first surface area and a second end defining a second surface area, the body being tapered from the first end to the second end such that the first surface area is larger than the second surface area; forming a nested arrangement of mailboxes by positioning the second end of one mailbox into the first end of another mailbox; and placing the nested arrangement of mailboxes in a container.

The mailbox and method of the present invention thus overcome the high shipping, display, and storage space requirements attendant to conventional mailboxes.

Additional objects and advantages of the invention will become apparent to those skilled in the art upon examination of the following description of the preferred embodiment.

DETAILED DESCRIPTION OF THE INVENTION

Figure 1:
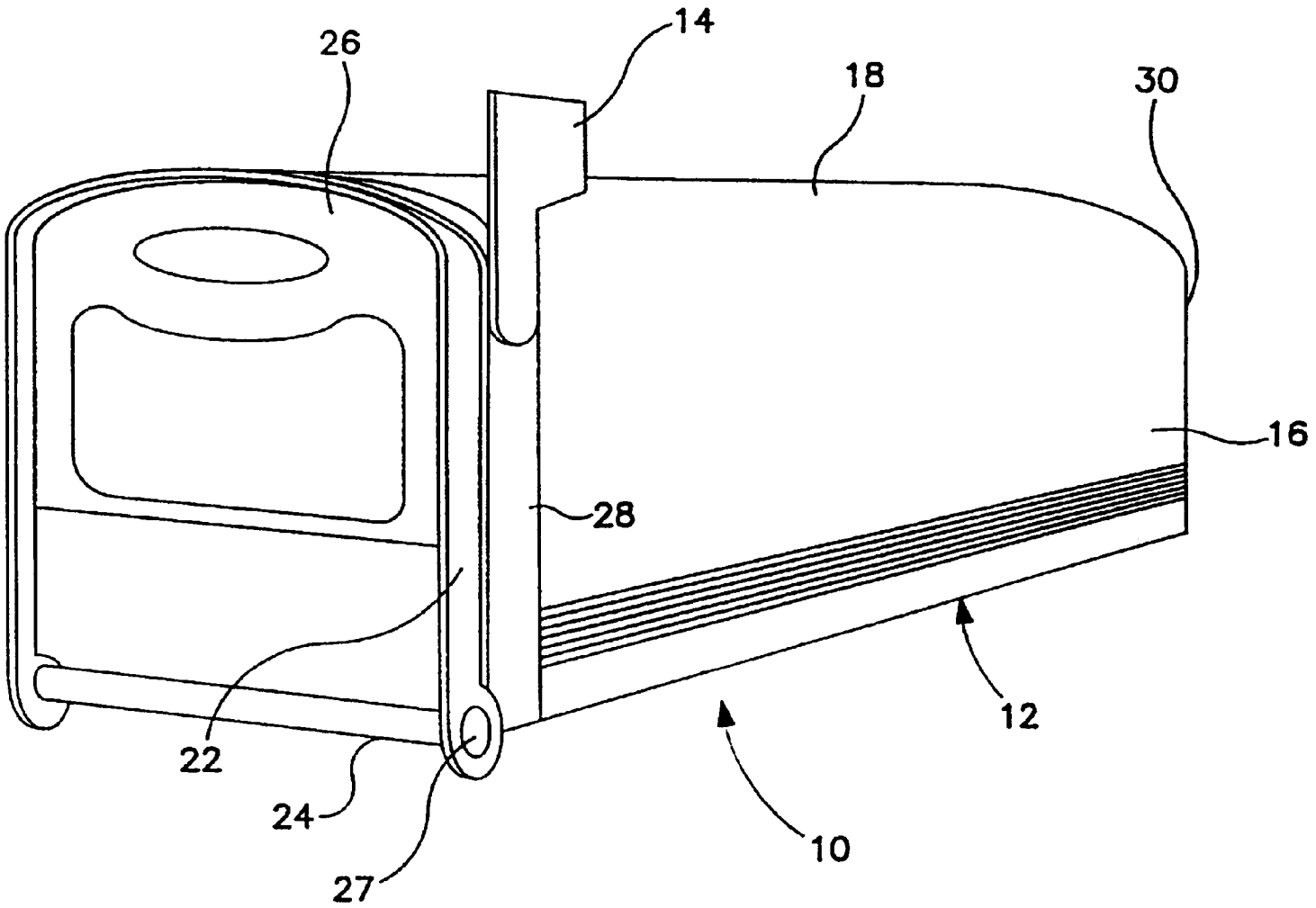
FIG. 1 is a perspective view of a mailbox constructed in accordance with a preferred embodiment of the present invention.
Figure 1A:
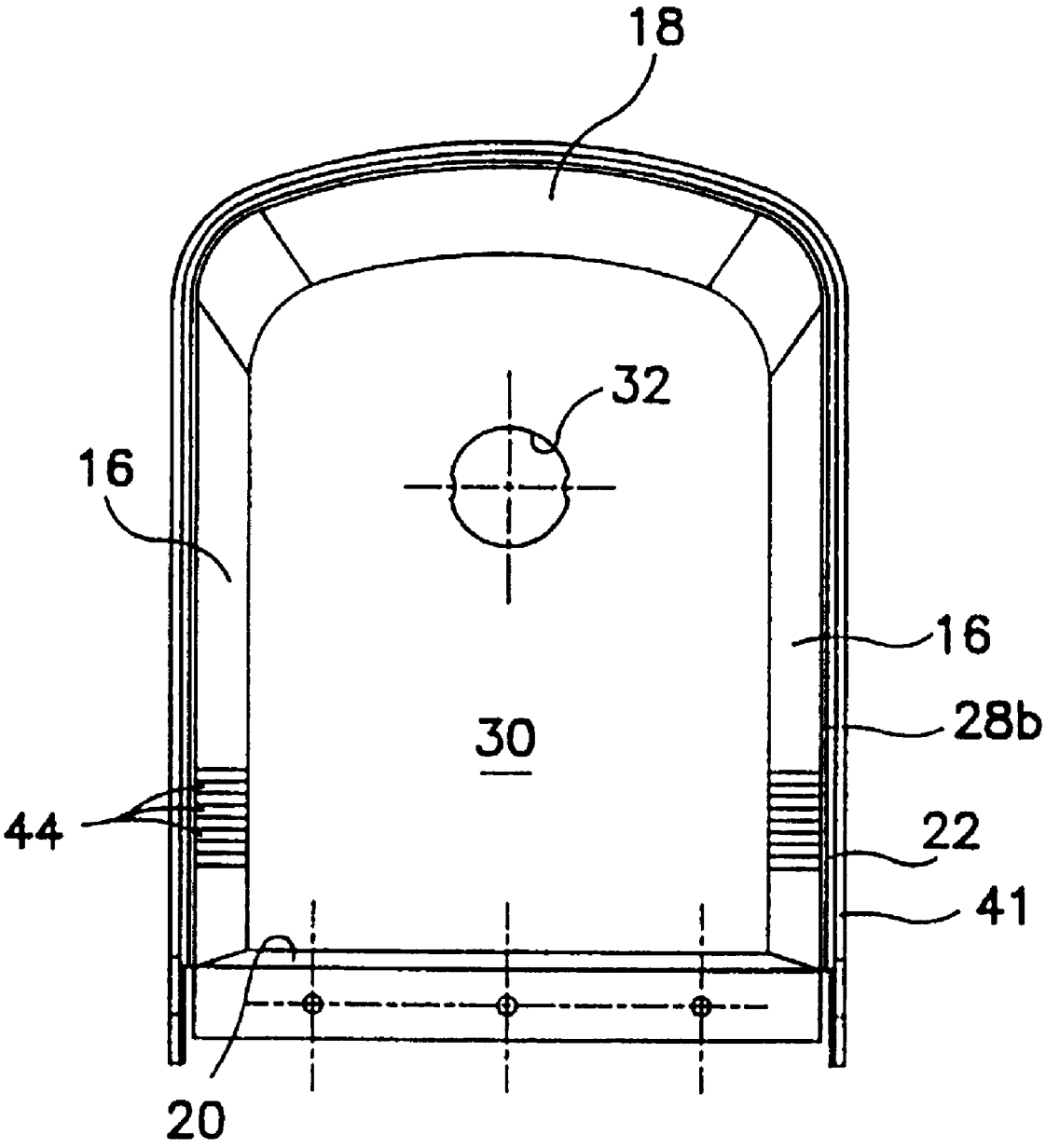
FIG. 1A is an end view of a back end of a mailbox constructed in accordance with a preferred embodiment of the present invention.
Figure 4:
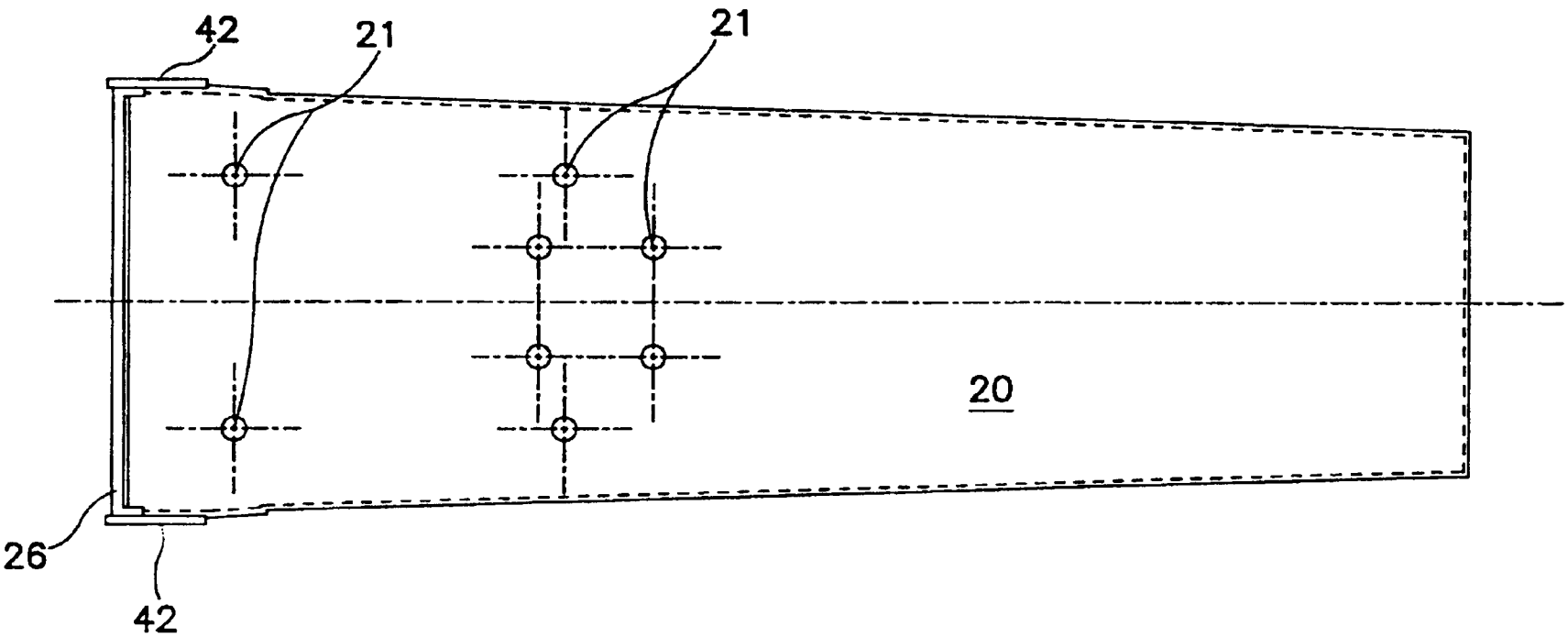
FIG. 4 is a bottom view of a mailbox constructed in accordance with a preferred embodiment of the present invention.

Referring to FIGS. 1, 1A, and 4, a mailbox 10 is shown, including a body 12 carrying a flag 14. The body 12 is primarily comprised of a pair of spaced side walls 16, an arched top 18 integrally connected to the side walls 16, and a bottom panel 20 (into which a plurality of apertures 21 are formed for mounting mailbox 10 to a support) connected to the side walls 16 opposite arched top 18.

A first flared section 22 having a front face 24 extends around the side walls 16 and the arched top 18, such that front face 24 defines a first, or front, end of the body 12. Front end 24 is shown in FIG. 1 as being selectively closed by a door hingedly mounted at 27 to the first flared section 22. Thus, door 26 occupies the surface area circumscribed by the front end 24 and bottom panel 20.

A second flared section 28 extends around the side walls 16 and the arched top 18, is positioned rearwardly of the first flared section 22, and, as will be explained in greater detail with regard to FIG. 2, forms a raised shoulder with respect to arched top 18. Second flared section 28 preferably touches the first flared section 22 and is preferably formed integrally with top wall 18, side walls 16, and the first flared section 22. Thus, the body 12 is preferably constructed as one piece, including the flared sections 22, 28 such that these sections are considered as parts of the body 12.

As best seen in FIG. 1A, body 12 also has a second, or back, end, which is collectively defined by the rear termini of arched top 18 (sloping downwardly), side walls 16 (tapering inwardly), and bottom panel 20. Preferably, this back end is always completely closed by a back panel 30, which thus occupies the entire surface area circumscribed by the back end. (Consequently, reference numeral 30 will be hereinafter used to identify both the back end of body 12 and the back panel.) Back panel 30 has an aperture 32 formed therein as a result of the process employed to manufacture the body 12. Preferably, aperture 32 is plugged with a plug member (not shown) after the back panel 30 is formed, and the clearance between the circumferential edge of the plug member and the aperture 32 suffices to admit air into the interior of the mailbox, thereby facilitating separation of nested mailboxes.

As will now be explained with regard to FIGS. 2 & 3, body 12 is tapered from the first end 24 to the second end 30, such that the surface area at the first end 24 is larger than the surface area at the second end 30.

Figures 2, 2A:
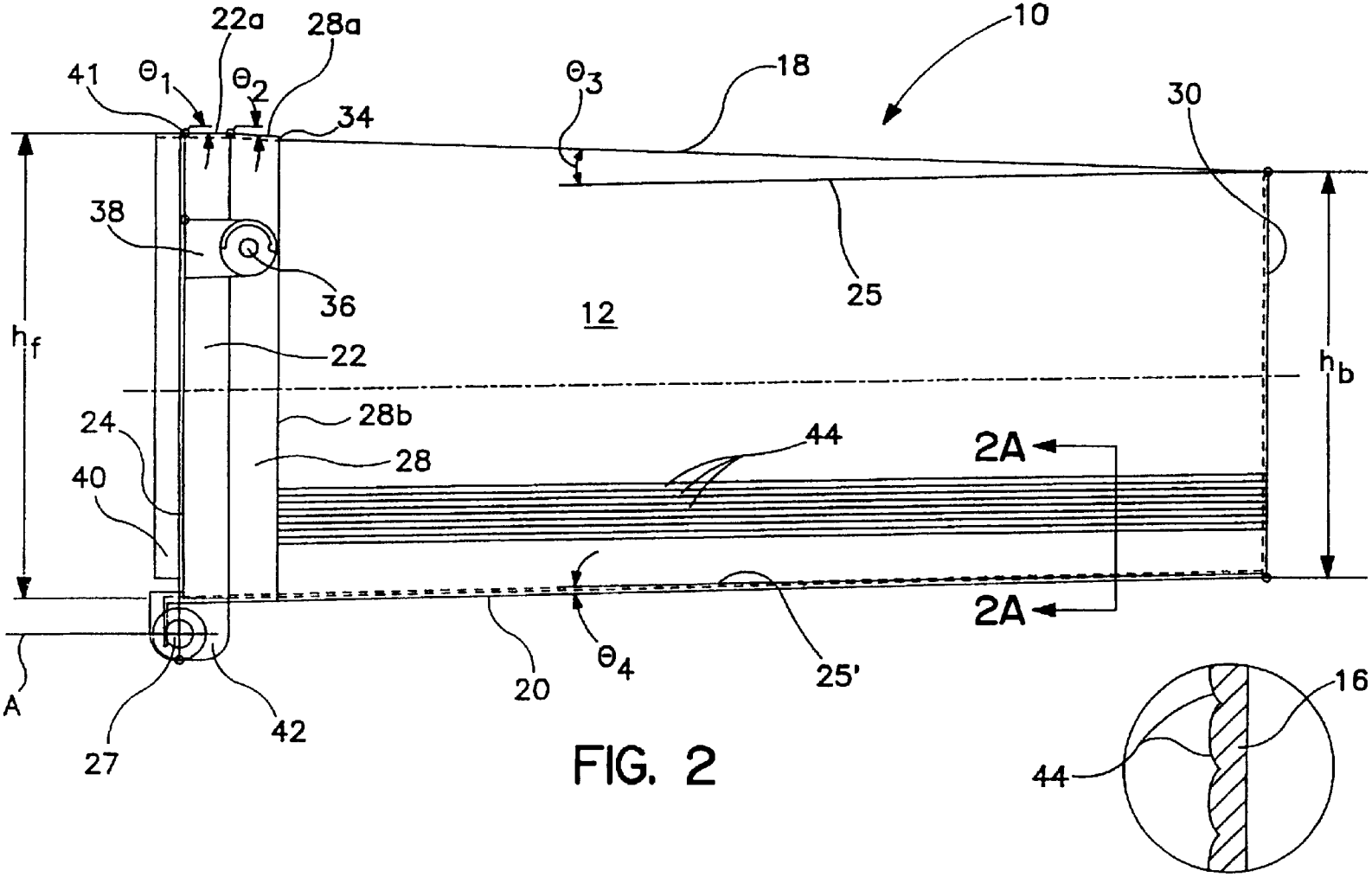
FIG. 2 is a side elevation view of a mailbox (omitting the flag and front door for purposes of illustration) constructed in accordance with a preferred embodiment of the present invention.
FIG. 2A is an enlarged sectional elevation view taken along line 2A—2A in FIG. 2.

Referring to FIG. 2, a side elevation view omitting flag 14 and door 26 for purposes of illustration, it is readily seen that the height ($h_f$) at the front end 24 is of a larger magnitude than the height ($h_b$) at the back end 30. First, the upper surface 22*a* of first flared section 22 declines from the horizontal by an angle $\theta_1$, and the upper surface 28*a* of second flared section 28 declines from the horizontal by an even greater angle $\theta_2$. At back edge 28*b* of second flared section 28, it is seen that upper surface 28*a* of second flared section 28 is at a slightly higher elevation than the arched top 18 of the body 12, thereby forming a shoulder 34. Arched top 18 then declines from the horizontal, moving toward back end 30, by an angle $\theta_3$, equal to the angle shown between top 18 and horizontal line 25. Additionally, bottom panel 20 inclines from the horizontal by an angle $\theta_4$, equal to the angle shown between bottom panel 20 and horizontal line 25'. In the preferred embodiment, magnitudes for the aforementioned angles are as follows:

$\theta_1$=1.500°

$\theta_2$=5.096°

$\theta_3$=3.000°

$\theta_4$=0.500°

Also shown in FIG. 2, a pivotal flag mount 36, as well as a recessed portion 38, are formed into the first flared section 22 and the second flared section 28. Mailbox 10 may also be provided with a door seat 40, attached to front end 24 and extending substantially conterminously therewith. Door seat 40, like the flared sections 22 and 28, is preferably formed as one piece with the body 12 of mailbox 10. Door 26 (FIG. 1) has a lip (not shown) mounted on the interior surface thereof, such that when in a closed position, that lip engages door seat 40, with door 26 then covering the door seat 40 (see FIGS. 3 & 4). Preferably, mailbox 10 is also provided with an outer lip 41 between the door seat 40 and first flared section 22, so as to aid in preventing rain water from entering the mailbox enclosure when door 26 is opened. Additionally, a lower portion of flared section 22 may extend downwardly to form an ear portion 42, which has an aperture formed therein to allow a transverse pin 27 to hingedly mount door 26 to the body 12.

Referring to FIGS. 2 & 2A, a band of scalloped surfaces 44 may be formed into the exterior surface of at least one of the side walls 16 of body 12. Such a band, preferably formed as a continuous series of circle segments, both imparts an aesthetic appearance to the mailbox 10 and admits air across the mailbox exterior surface, facilitating separation of mailboxes from a nested arrangement, to be described in detail herein.

Figure 3:
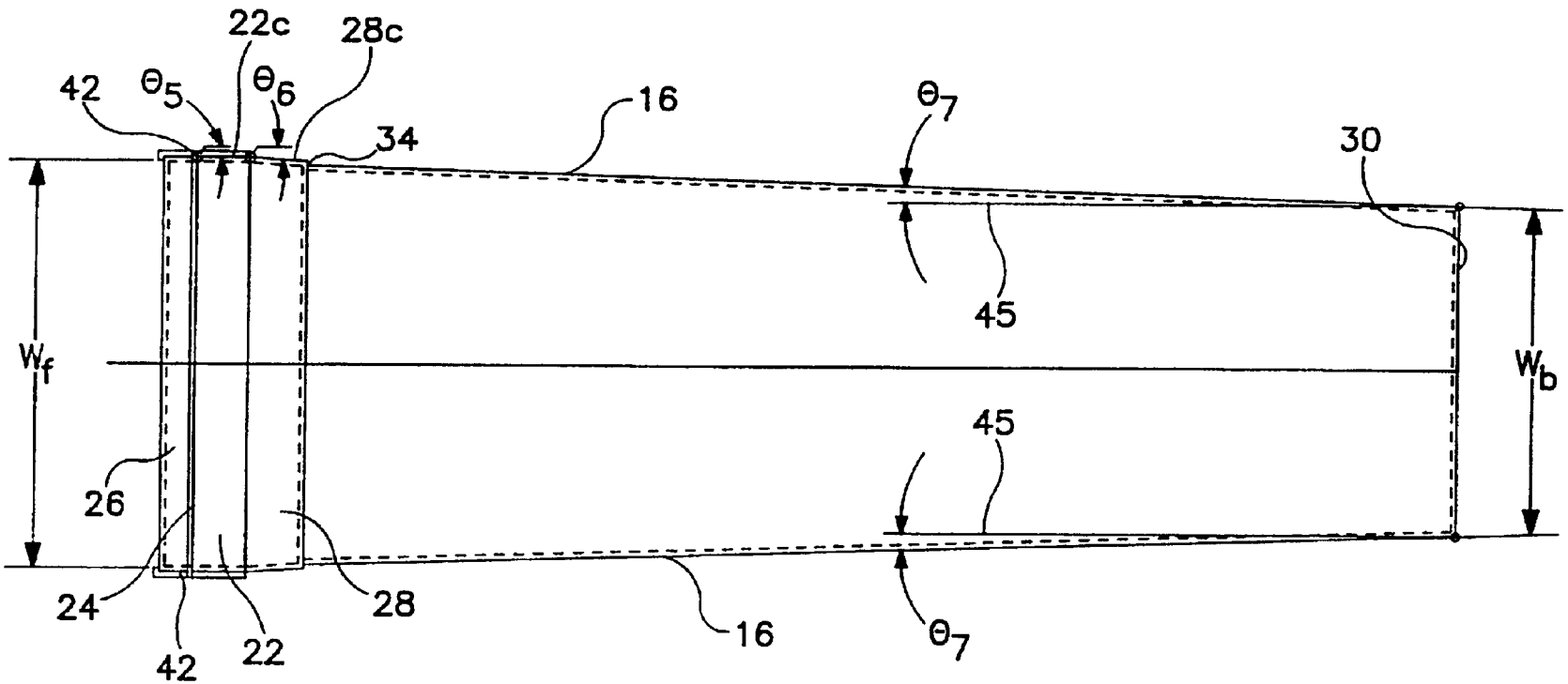
FIG. 3 is a plan view of a mailbox constructed in accordance with a preferred embodiment of the present invention.

Referring to FIG. 3, mailbox 10 is shown in a plan view, whereby it is seen that the width ($w_f$) at the front end 24 is of a larger magnitude than the width ($w_b$) at the back end 30. At the point where first flared section 22 meets the door seat 42, side wall 22*c* of the first flared section 22 tapers, moving from first end 24 toward second end 30, by an angle $\theta_5$ from a datum line (defined as a line perpendicular to the line representing end 30 in FIG. 3). Side wall 28*c* of second flared section 28 tapers by an angle $\theta_6$ from the datum line. Shoulder 34 is shown between side walls 28*c* and 16. Although not explicitly labeled as such, both sides of the flared sections 22, 28 respectively taper in the manner just described. Furthermore, each side wall 16 tapers from the datum by an angle $\theta_7$, equal to the angle shown between each wall 16 and datum lines 45. Magnitudes for the aforementioned angles are preferably as follows:

$\theta_5$=1.500°

$\theta_6$=5.096°

$\theta_7$=1.750°

Regarding the materials comprising the mailbox 10, both the body 12 and the flag 14 are preferably constructed of polypropylene. Other plastics, such as polyethylene, may be used. The present invention additionally contemplates that the body 12 may be constructed of metal or wood.

Figure 5:
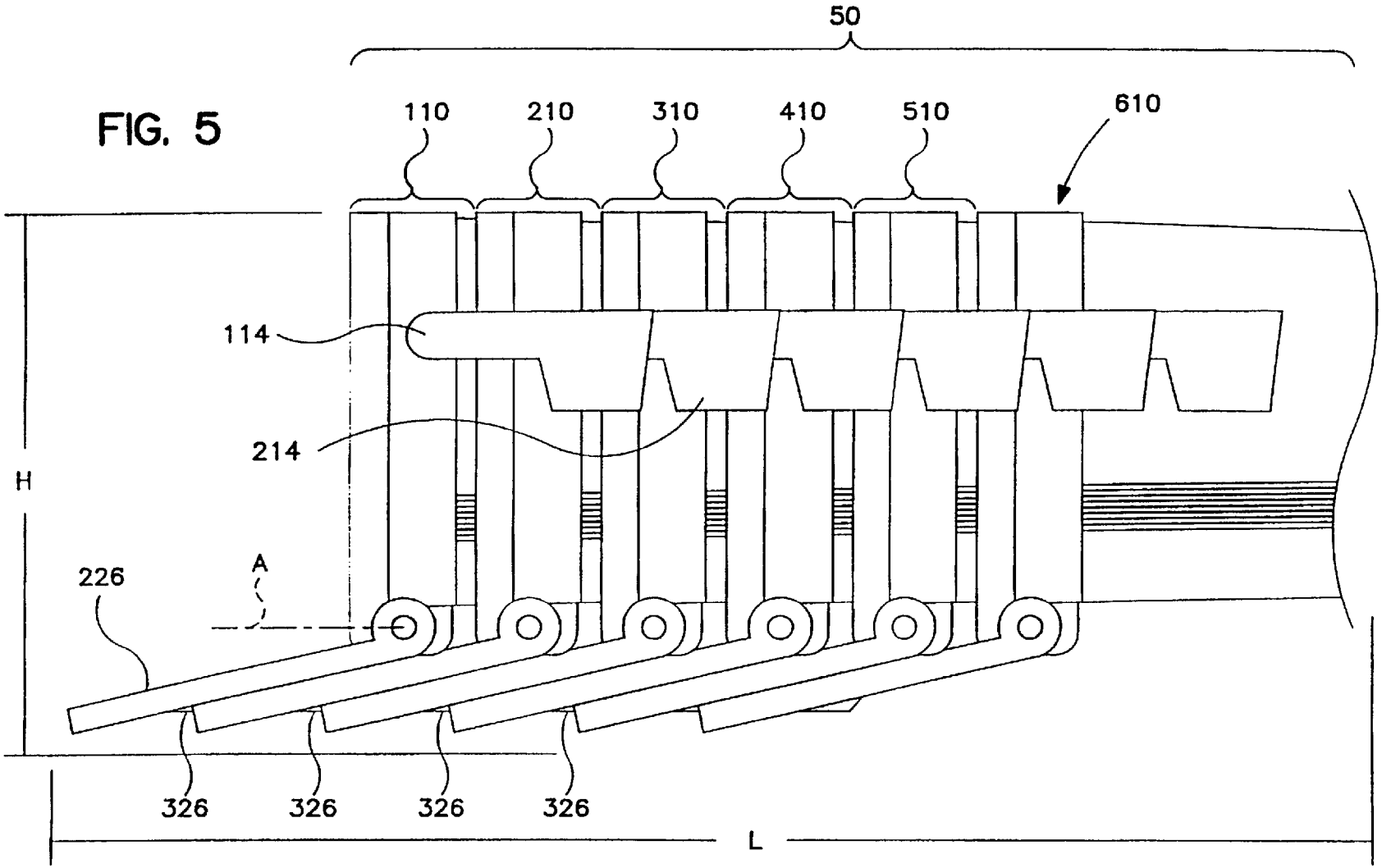
FIG. 5 is a perspective view of a plurality of mailboxes constructed in accordance with a preferred embodiment of the present invention, positioned in a nesting arrangement, wherein the door of each mailbox, except for the front-most mailbox, is opened downwardly toward the front.
Figure 6:
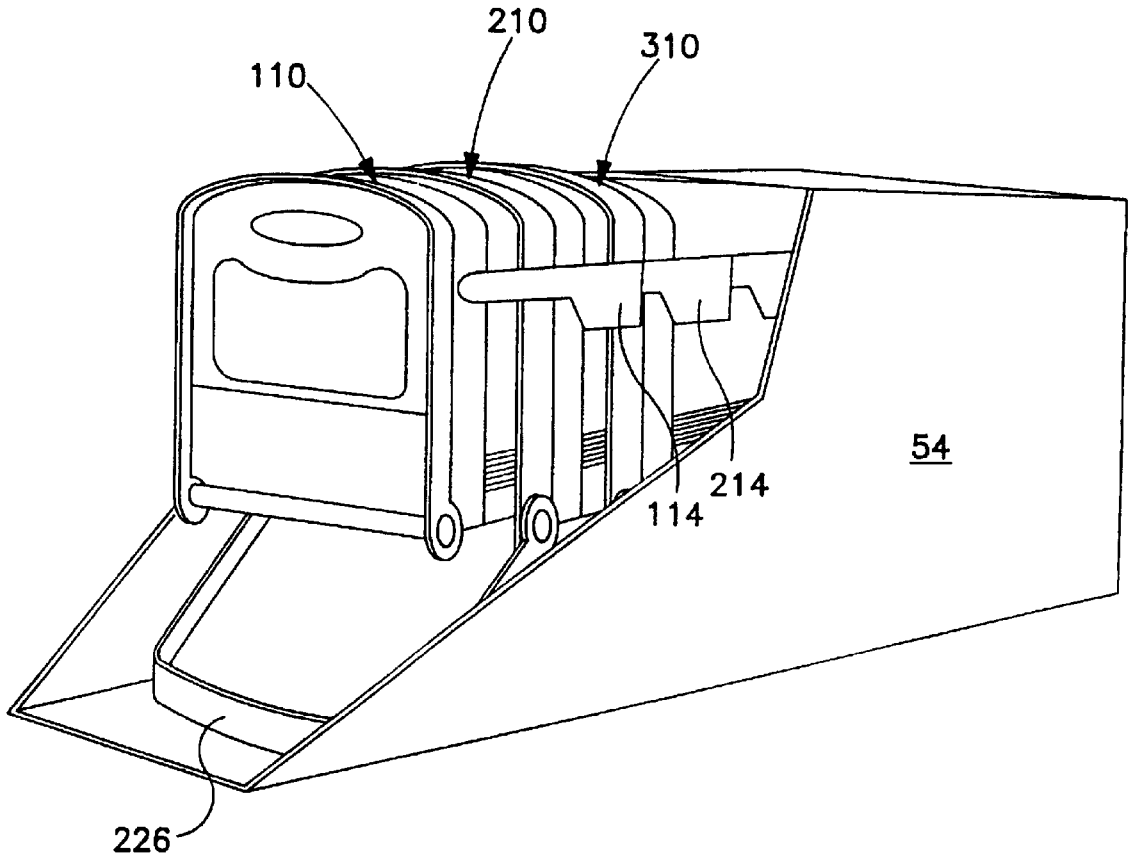
FIG. 6 is a perspective view similar to FIG. 5, showing the plurality of nested mailboxes packed in a carton, shown in a cut-away view.

FIGS. 5 & 6 depict a plurality of mailboxes ("plurality" meaning two or more), here, six mailboxes 110, 210, 310, 410, 510, and 610, each constructed in accordance with the preferred embodiment of the present invention, nested according to the preferred method of the present invention. A nested arrangement 50 of mailboxes is formed by opening the doors 226–626 of mailboxes 210–610 (but not the front-most mailbox 110) such that the first (front) end of each of these mailboxes are now open. Next, the second (back) end of one mailbox is positioned into the opened first (front) end of another mailbox. The latter step is repeated until all mailboxes designated for shipment within a single container have been nested. Finally, the nested arrangement of mailboxes 50 is placed in a container, such as a carton 52 having suitable dimensions "H" and "L" to encapsulate the nested arrangement, if container 52 is intended for shipment. If the container 52 is instead intended for display purposes, it may have the cut-out section shown to promote visibility of the nested arrangement 50.

Figure 7:
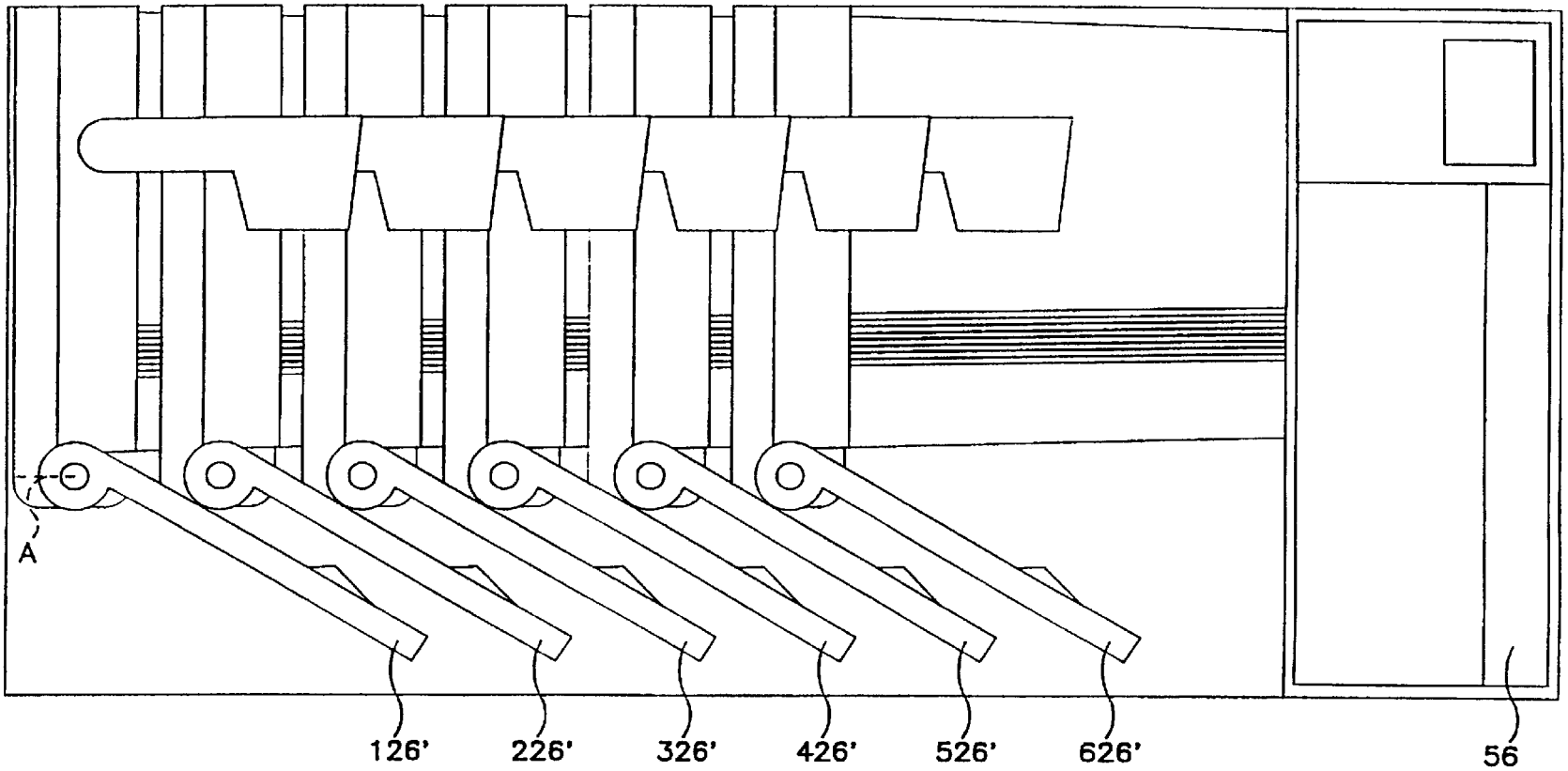
FIG. 7 is a side view of a plurality of nested mailboxes constructed in accordance with a preferred embodiment of the present invention, packed in a carton, shown in a cut-away view, wherein doors of each mailbox are opened downwardly toward the rear.

FIG. 7 shows a similar arrangement of nested mailboxes, shown as residing in a carton 56, except that the doors of all of the mailboxes (including that of the front-most mailbox) have been opened, and except that the opened doors point downwardly and rearwardly. Doors 126', 226', 326', 426', 526', & 626' are also oriented substantially parallel with one another. As used herein, "downwardly and rearwardly" means that a door assumes an obtuse angle, measured counterclockwise from horizontal axis A (also seen in FIG. 2). Axis A passes through the center of pivot pin 27 and is perpendicular to a side elevation of back end 30. By contrast, the doors in FIGS. 5 & 6 are oriented downwardly and frontwardly, i.e., at an acute angle measured counterclockwise from horizontal axis A.

Figure 8:
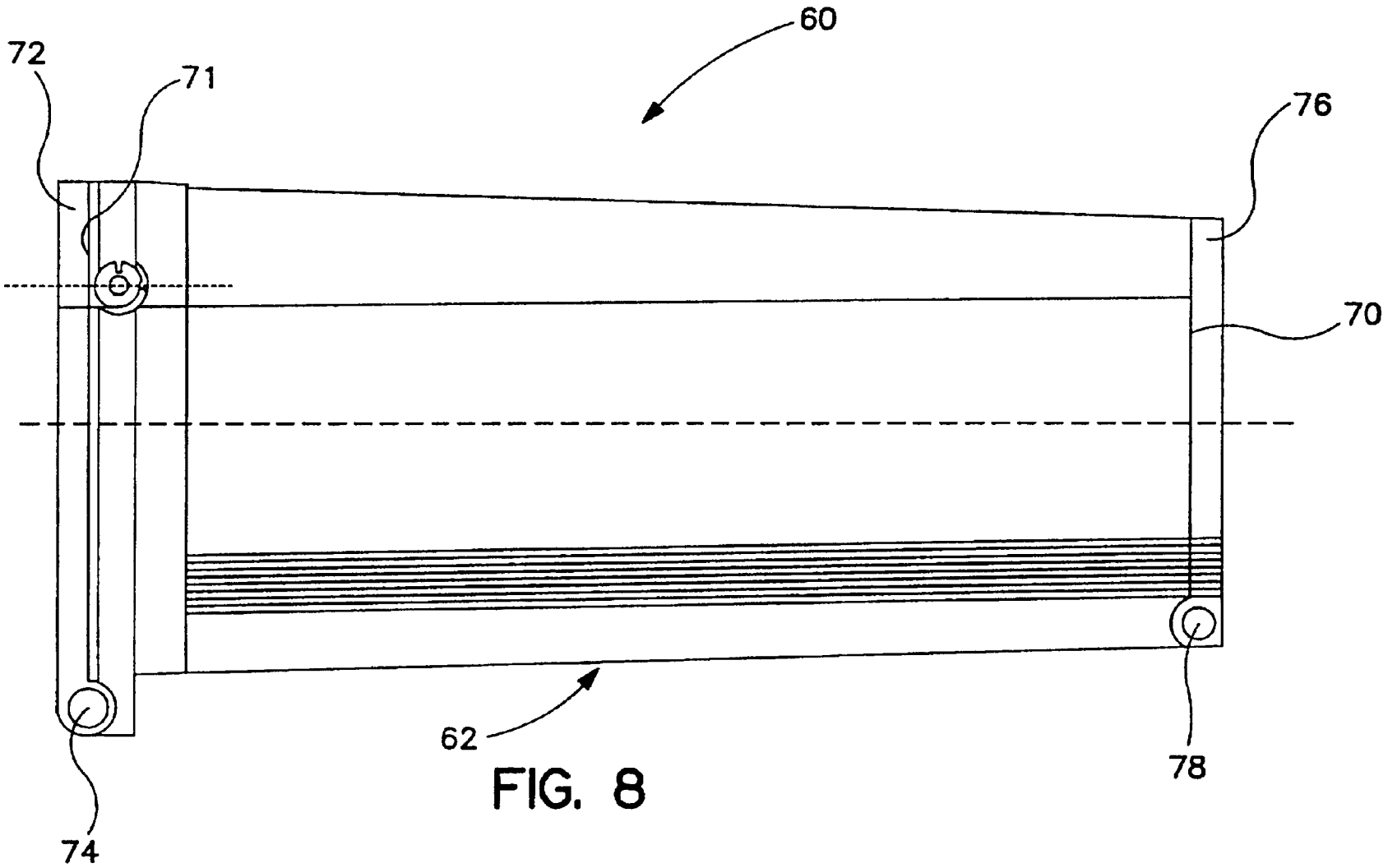
FIG. 8 is a side elevation view of a dual-door nestable mailbox, constructed in accordance with a modified embodiment of the present invention.
Figure 9:
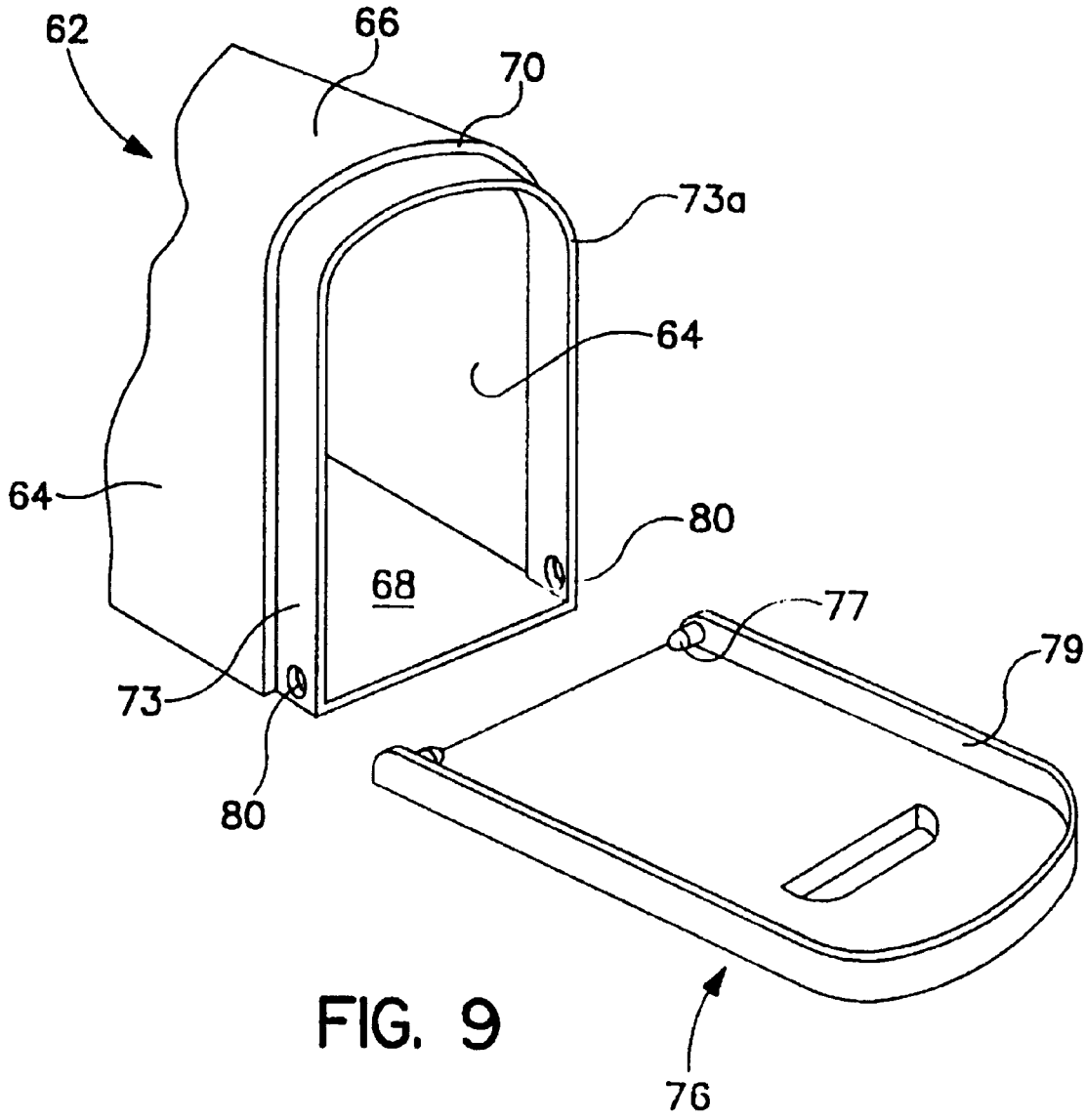
FIG. 9 is a partial perspective view of the body of the mailbox illustrated in FIG. 8, depicting a back door in removably connectable relation to the back end of the body.

In a modified embodiment, the mailbox of the present invention may be provided with a door at each end, rather than just at the front end, as described with regard to the preferred embodiment. Referring to FIGS. 8 & 9, such a mailbox 60 includes a body 62 which has side walls 64, a top 66, and a bottom panel 68 to define the mailbox enclosure. The rear termini of the side walls 64 and top 66 define the back end 70 of the body 62, opposite a front end 71 of the body 62. Mailbox 60 is additionally provided with a front door 72 hingedly mounted to the body 62 proximate the front end 71 by way of a transverse pin 74.

As best seen in FIG. 9, a back door seat 73 extends axially rearwardly from back end 70 and radially inwardly from back end 70 by a magnitude approximating the thickness of the body walls at end 70. Back door seat 73 thus serves as a rearward extension of body 62 and assumes a reduced, stepped relation with respect to end 70. Bottom panel 68 also extends axially rearwardly such that its terminus is coplanar with respect to terminus 73*a* of back door seat 73, thereby, in conjunction with terminus 73*a*, circumscribing the rear opening of body 62. Apertures 80 are formed into the lower portions of the back door seat 73. A back door 76 is hingedly mounted to the back door seat 73 by way of pins 77 integrally carried by the interior surface of a rim 79 lining the back door 76. The pins 77 are received within apertures 80, and since the back door 76 is preferably constructed of a resilient material, such as polypropylene, the back door 76 may be mounted to the back door seat 73 by pulling outwardly on the rim 79 proximate the pins 77, aligning the pins 77 with the apertures 80, and releasing the rim 79, such that the rim 79 biases the pins 77 within the apertures 80. With this construction, back door 76 may be easily mounted to the body 62.

Figure 10:
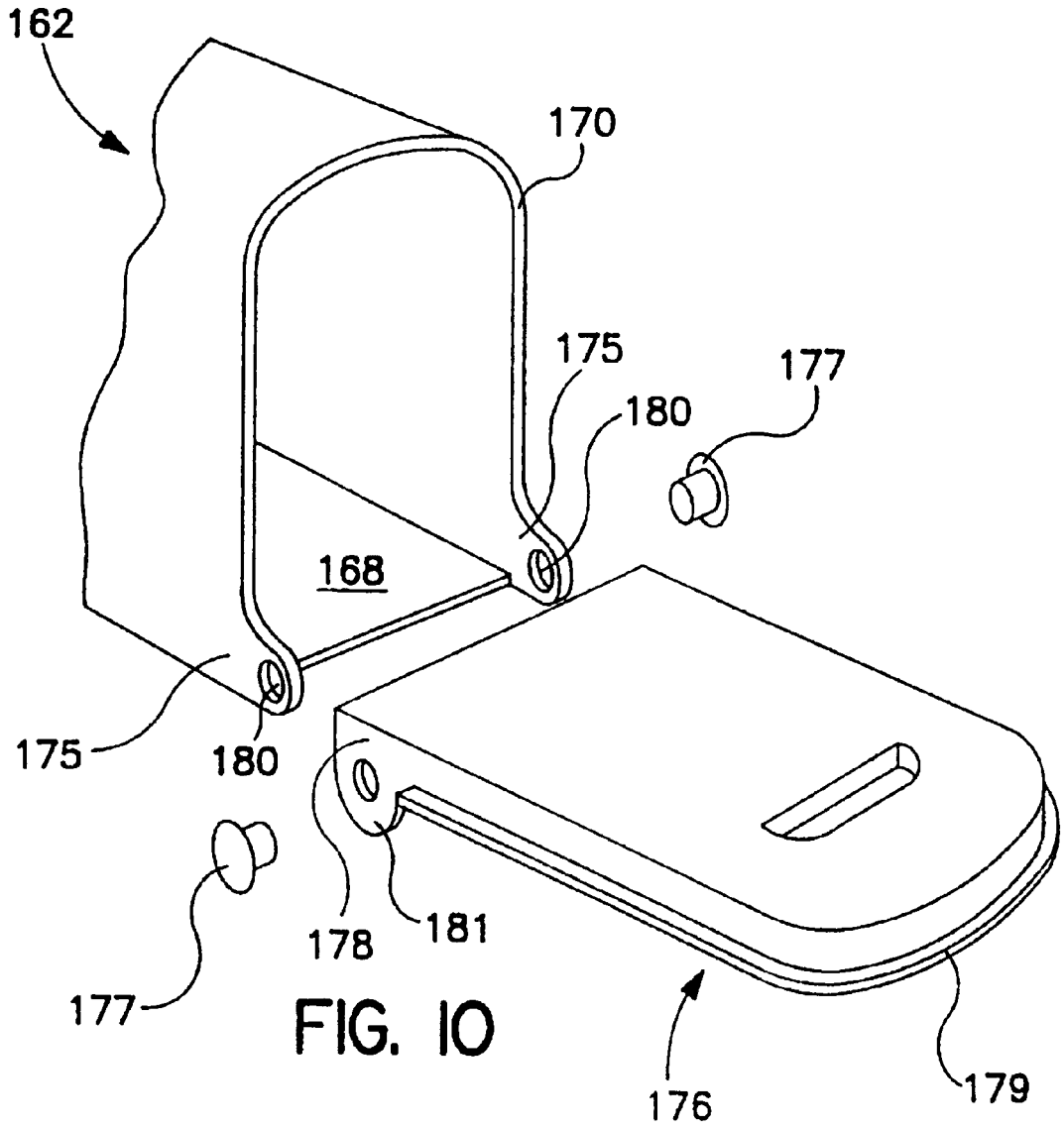
FIG. 10 is an exploded, partial perspective view of the body and rear door of a nestable mailbox constructed in accordance with another modified embodiment of the present invention.
Figure 11:
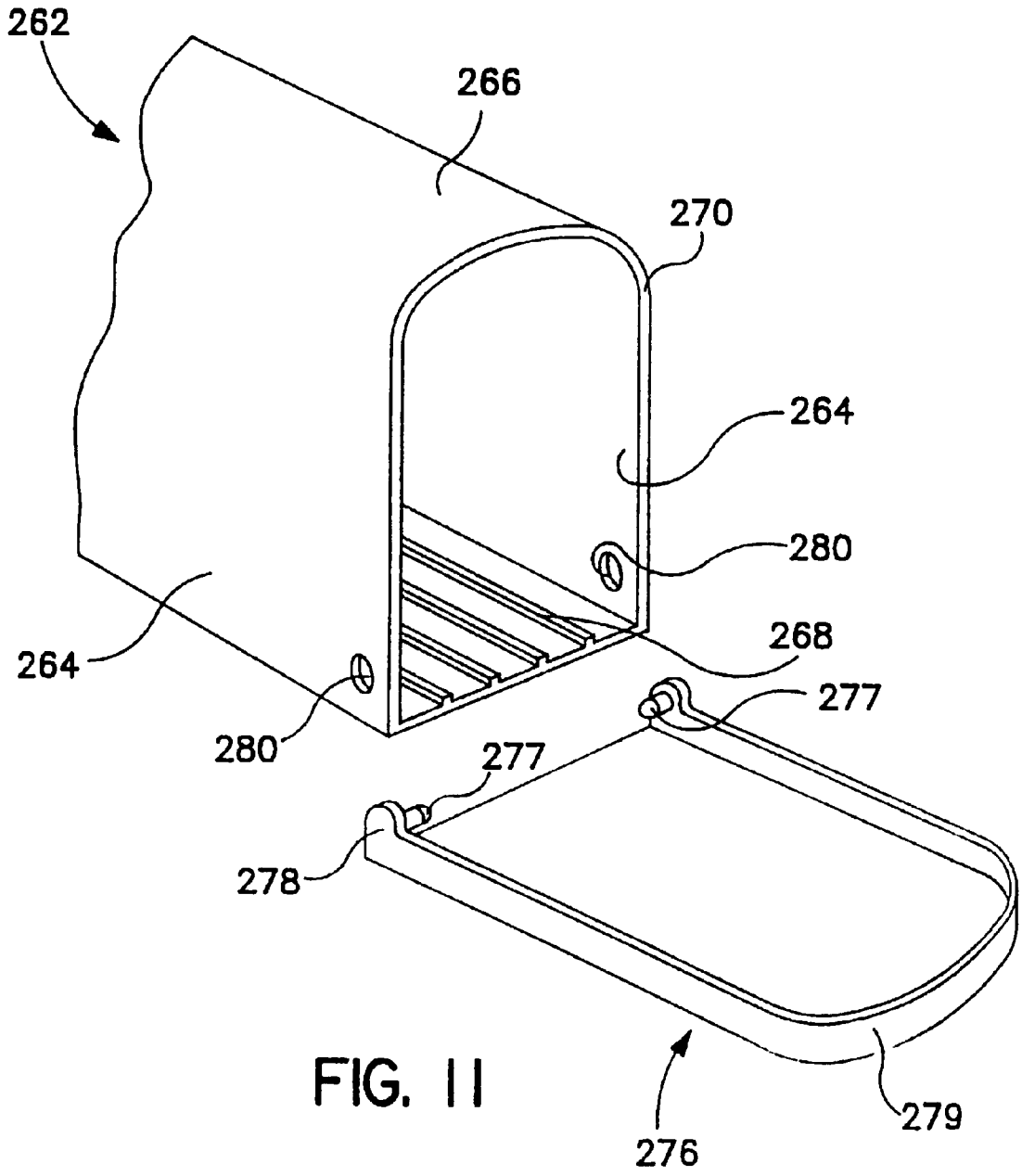
FIG. 11 is a partial perspective view of the body and rear door of a nestable mailbox constructed in accordance with yet another modified embodiment of the present invention.

The dual-door nestable mailbox may also be constructed in accordance with further modified embodiments, such as those shown in FIGS. 10 & 11.

Referring to FIG. 10, the nestable mailbox can have a body 162 having a back end 170 which, at its lower portions, extends axially rearwardly to form ear members 175, into which apertures 180 are formed. A rear door 176 carries similar ear members 178, which have apertures 181 formed therein. Rear door 176 is mounted to body 162 by aligning apertures 180, 181, then by inserting hinge pins 177 therethrough. Once the rear door 176 is mounted to the body 162 and moved to a closed position, the rear door 176 it is contained within the enclosure of body 162 at the end 170, except that outer rim 179 of the rear door 176 abuts the end 170.

Referring to FIG. 11, a nestable mailbox may include a body 262 which has side walls 264, a top 266, and a bottom panel 268 to define the mailbox enclosure. The rear termini of the side walls 264, top 266, and bottom panel 268 collectively define the back end 270 of the body 262, opposite a front end of the body 262. A back door 276 is hingedly mounted to the body 262 proximate the back end 270 by way of pins 277 integrally carried by respective interior surfaces of ear members 278 extending downwardly from the outer periphery, or rim 279, of the back door 276. The pins 277 are removably received within apertures 280 formed into a lower portion of each of the side walls 264 proximate back end 270. Since the ear members 278 are preferably constructed of a resilient material, such as polypropylene, the back door 276 may be mounted to the body 262 by pulling outwardly on the ear members 278, aligning the pins 277 with the apertures 280, and releasing the ear members 278, such that the ear members 278 bias the pins 277 within the apertures 280. With this construction, back door 276 may be easily snapped into place or removed from the body 262.

Referring to FIGS. 12–16, a mailbox 310 is shown, including a body 312 carrying a flag 314. The body 312 is primarily comprised of a pair of spaced side walls 316, an arched top 318 integrally connected to the side walls 316, and a bottom panel 320, into which a plurality of apertures 321 are formed for mounting mailbox 310 to a support. The bottom panel 320 has formed therein a plurality of rail elements 341 which also have a plurality of apertures 321 formed both in the bottom and the sides of each rail element 341. The bottom panel 320 is connected to the side walls 316 opposite arched top 318.

Figure 16:
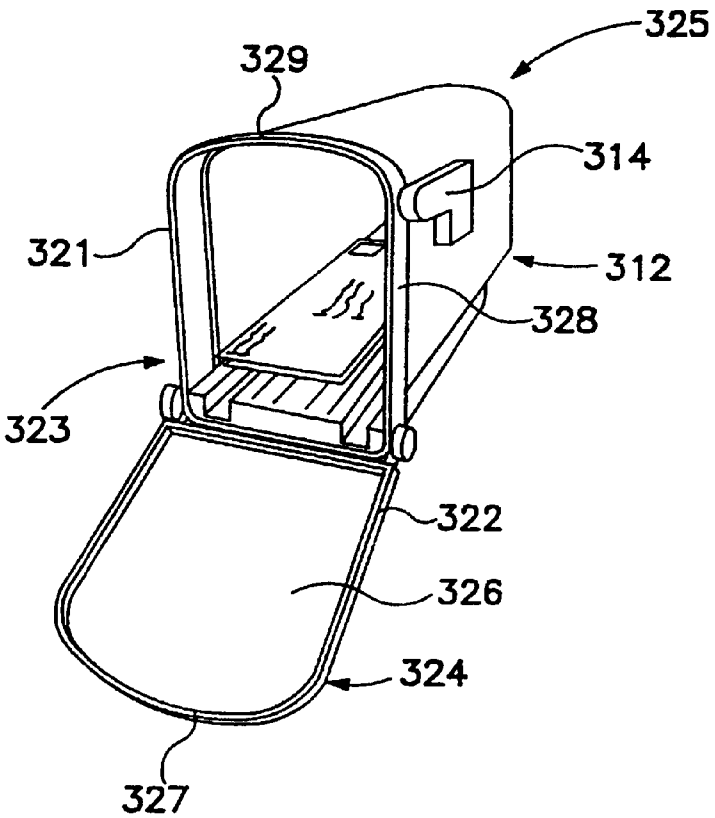
FIG. 16 is a front perspective view showing the second embodiment of the present invention in an alternative use.
Figure 15:
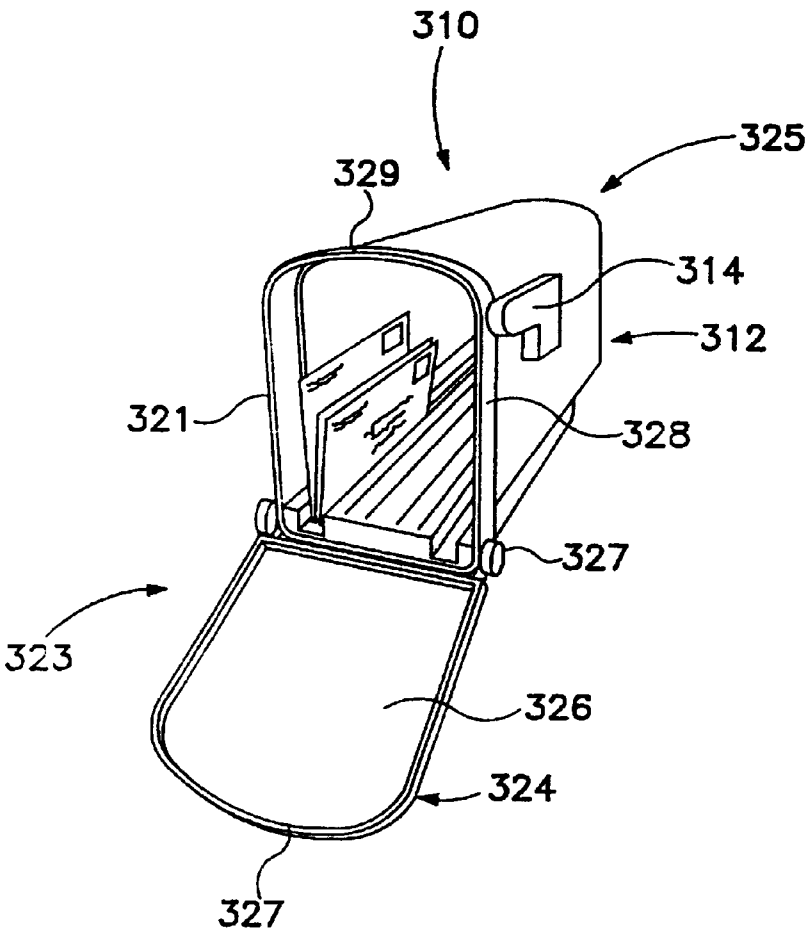
FIG. 15 is a front perspective view showing the second embodiment of the present invention in use.

A first flared section 322 having a front face 324 extends around the side walls 316 and the arched top 318, such that front face 324 defines a first, or front, end 323 of the body 312. The first end 323 is shown in FIGS. 15 & 16 as being selectively open by a door 326 hingedly mounted at 327 to the first flared section 322. Thus, door 326 occupies the surface area circumscribed by the front end 324 and bottom panel 320.

A second flared section 328 having a front face 321 extends around the side walls 316 and the arched top 318, is positioned rearwardly of the first flared section 322, and, as will be explained in greater detail with regard to FIGS. 15 & 16, forms a raised shoulder with respect to arched top 318. Second flared section 328 preferably touches the first flared section 322 and is preferably formed integrally with top wall 318 and side walls 316.

Figure 12:
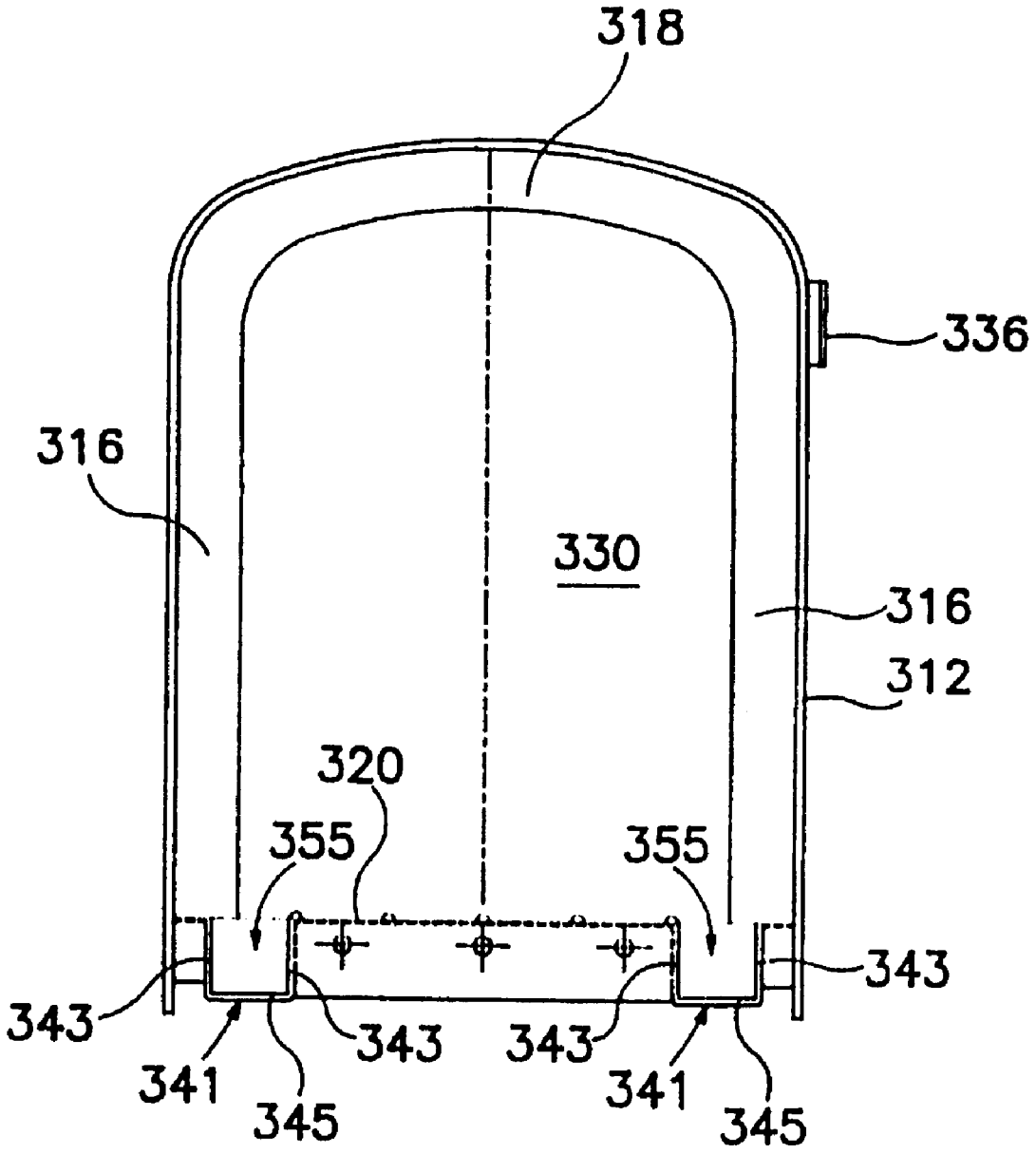
FIG. 12 is an end view of a back end of a mailbox constructed in accordance with a second embodiment of the present invention.

As best seen in FIG. 12, body 312 also has a second, or back end 325, which is collectively defined by the rear termini of arched top 318 (sloping downwardly), side walls 316 (tapering inwardly), and bottom panel 320. Preferably, this back end 325 is completely closed by a back panel 330, which thus occupies the entire surface area circumscribed by the back end 325. However, the back end may have a rear entrance door similar to the door on the front only slightly smaller in shape as to accommodate the size of the mailbox at the second end 325. Back panel 330 has an aperture (not shown) formed therein as a result of the process employed to manufacture the body 312. Preferably, the aperture is plugged with a plug member (also not shown) after the back panel 330 is formed, and the clearance between the circumferential edge of the plug member and the aperture suffices to admit air into the interior of the mailbox, thereby facilitating separation of nested mailboxes.

As will now be explained with regard to FIG. 13, body 312 is tapered from the first end 323 to the second end 325, such that the surface area at the first end 323 is larger than the surface area at the second end 325.

Figure 13:
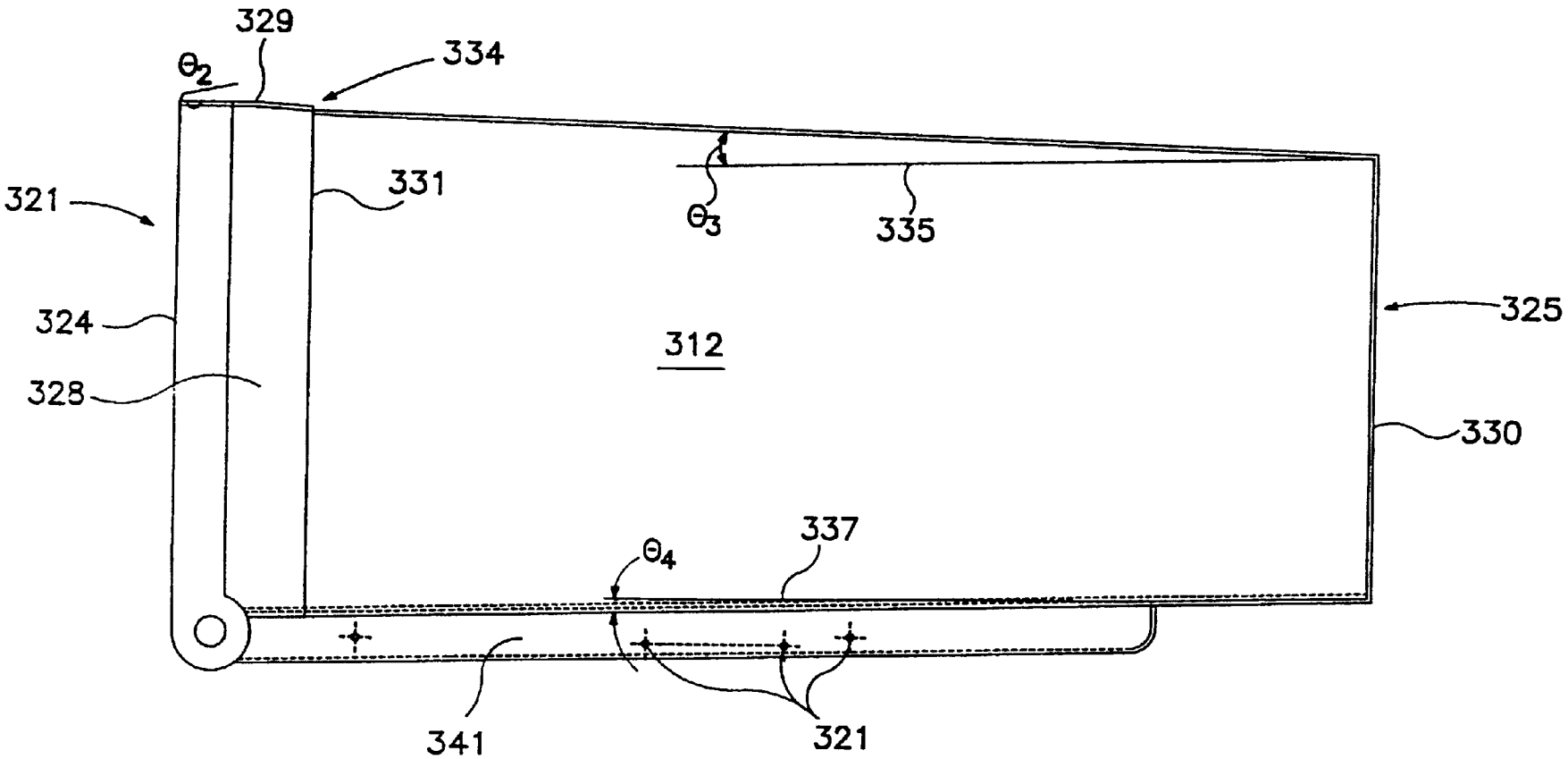
FIG. 13 is a side elevational view of a mailbox (omitting the flag and front door for purposes of illustration) constructed in accordance with a second embodiment of the present invention.

Referring to FIG. 13, a side elevation view omitting flag 314 and door 326 for purposes of illustration, it is readily seen that the height ($h_f$) at the first end 323 is of a larger magnitude than the height ($h_b$) at the second end 325. First, the upper surface 327 of first flared section 322 declines from the horizontal by an angle $\theta_1$ (not shown), and the upper surface 329 of second flared section 328 declines from the horizontal by an angle $\theta_2$. At back edge 331 of second flared section 328, it is seen that upper surface 329 of second flared section 328 is at a slightly higher elevation than the arched top 318 of the body 312, thereby forming a shoulder 334. Arched top 318 then declines from the horizontal, moving toward back end 330, by an angle $\theta_3$, equal to the angle shown between top 318 and horizontal line 335. Additionally, bottom panel 320 inclines from the horizontal by an angle $\theta_4$, equal to the angle shown between bottom panel 320 and horizontal line 337. In the preferred embodiment, magnitudes for the aforementioned angles are as follows:

$\theta_1$=1.500°

$\theta_2$=5.096°

$\theta_3$=3.000°

$\theta_4$=0.500°

Also shown in FIG. 12, a pivotal flag mount 336, as well as a recessed portion (not shown), are formed into the second flared section 328.

Figure 14:
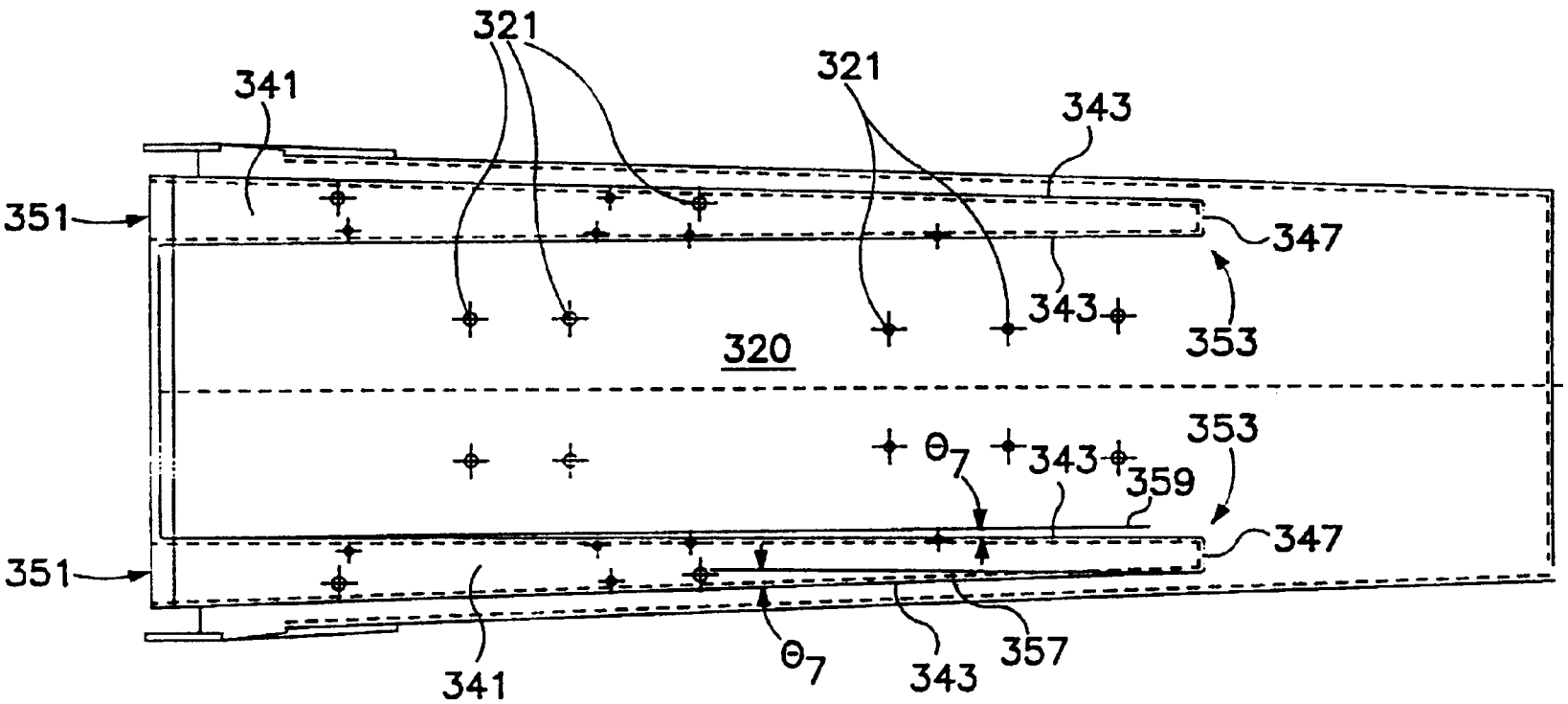
FIG. 14 is a bottom view of a mailbox constructed in accordance with a second embodiment of the present invention.

FIG. 14 discloses a different embodiment of the claimed invention. This embodiment distinguishes from the others by the two rail elements 341 located along the bottom panel 320. These rail elements 341 are used to secure the mailbox to a post without the use of a mounting bracket. They also allow a person to place their fingers underneath an object in the mailbox by sliding the persons fingers in the front end 351 of the rail element 341 and then lifting up on the object. Preferably, each rail element 341 is integrally formed with the bottom panel 320 of the mailbox, but derivations, such as separate rail elements 341 may be added to the bottom panel 320. The rail elements 341 have a front end 351 and a rear end 353 and extend from the first end 323 of the body 312 toward the second end 325 of the body 312 on the bottom panel 320. Each rail element 341 is a channel or trough-like shape 355 having two side panels 343, a lower or bottom panel 345 and a rear panel 347. The lower panel 345 is located between each side panel 343 and integrally connected to each side panel 343 hence forming a trough or channel. The front end 351 of each rail element 341 is open allowing easy access to the channel portion as shown in FIGS. 15 & 16. The rear end 353 of the rail element 341 is closed by the rear panel 347 and the lower panel 345. The outer panel of each rail element 341 is angled at the same degree as the side walls of the body 312, angle $\theta_7$. That is, each side panel 343 of the rail element 341 tapers from the datum by an angle $\theta_7$, equal to the angle shown between each outer side panel 343 and datum line 357. The inner side panel of each rail element 341 also tapers from the datum by an angle of $\theta_7$. Such angle is defined in much the same way as that of the outer side panel, that being the angle is equal to that shown between each inner side panel 343 and the datum line 359. Therefore, with the inner side panels 343 tapering in toward the outer side panels 343 and the outer side panels 343 tapering toward the inner side panels 343, the channel portion 355 of each rail element 341 is wider at the front end 351 and narrower at the rear end 353. This shape is significant in that the two inner side panels 343 remain basically parallel to one another while still allowing numerous mailboxes to be nested with one another. The parallel configuration also allows for a wooden post to be placed between the rail elements and attached thereto from the bottom 320 or the side through the rail elements 341, thus eliminating the need and added expense of a mounting bracket. The channel portion 355 of the rail elements 341 also allow for letters and other objects placed inside the mailbox to be stood upright on end within the channel portion 355 making it easy and convenient to place and retrieve such letters and other objects. Also, the open front end 351 allows for the rear end 353 of another mailbox to be easily slid into and retained within the channel portion 355, hence allowing the mailboxes to be easily nested with one another.

A plurality of mailboxes constructed in accordance with the modified embodiments illustrated in FIGS. 8–16 may be nested within one another in the same manner as depicted in FIGS. 5–7. The steps in forming a nested arrangement would be substantially the same with the modified embodiment as those described with regard to the preferred embodiment, except that with the modified embodiment shown in FIG. 11, it may be desirable to remove the back doors of mailboxes prior to forming the nested arrangement, in the manner described below.

Specifically, in addition to ensuring that the first (front) door of at least one of the plurality of mailboxes assumes an open position (thereby forming an opened first end), as is of course necessary for the nesting of mailboxes constructed according to any embodiment of the present invention, the back door of each mailbox is removed from its associated body 262 by pulling the ear members 278 outwardly so as to remove, or to disengage, the pins 277 from respective apertures 280. In this manner, each back door 276 may be readily removed from its associated body 262. Instead of removing the back doors from all nested mailboxes, it may be desirable to retain the back door of the rear-most mailbox, thus removing the back doors only from those mailboxes which are to be nested in other mailboxes. Once the back doors are removed, they may be separately stacked or grouped together for shipment with the nested mailboxes, whereafter either the retailer or the ultimate purchaser of the mailbox may snap the back door to the body of a mailbox in the manner described above.

It is therefore seen that a mailbox that can be nested together with other like mailboxes for minimizing space required during shipping, storage, and display.

As the above description is merely exemplary in nature, being merely illustrative of the invention, many variations will become apparent to those of skill in the art. For instance, to the extent consistent with applicable postal regulations, the body 12 may be shaped as a frustum with the larger end at the front, and the body tapering symmetrically toward the smaller, back end. Such variations, however, are included within the spirit and scope of this invention as defined by the following appended claims.

That which is claimed:

1. A nestable mailbox comprising:

a body having a pair of spaced side walls, a top connected to said side walls, and a bottom panel connected to said side walls opposite said top, said body having a first end circumscribing a first surface area and a second end circumscribing a second surface area;

said body being tapered from said first end to said second end such that said first surface area is larger than said second surface area, and said distance between said first end and said second end is greater than the width of said first surface area;

a first flared section having a front face, said first flared section extending around said side walls and said top, whereby said front face of said first flared section defines said first end of said body;

a plurality of apertures formed in said first flared section for attaching a door thereto; and whereby said second end can be received in another mailbox constructed substantially identically to said nestable mailbox.

2. The nestable mailbox set forth in claim 1, wherein said body further comprises:

a second flared section extending around said side walls and said top, said second flared section positioned rearwardly of said first flared section and forming a raised shoulder with respect to said top.

3. The nestable mailbox set forth in claim 2, wherein said second flared section touches said first flared section.

4. The nestable mailbox set forth in claim 1, further comprising a band of scalloped sections formed into at least one of said side walls.

5. The nestable mailbox set forth in claim 1, wherein:

both said first end and said second end have dimensions of height and width; and said first end has a larger height and a larger width than the height and width of said second end.

6. The nestable mailbox set forth in claim 1, wherein said body is made from polypropylene.

7. The nestable mailbox set forth in claim 1, further comprising a first door mounted to said body proximate said first end.

8. The nestable mailbox set forth in claim 7, wherein:

said first flared section extends downwardly to form an ear portion; and said first door is hingedly mounted to said ear portion.

9. The nestable mailbox set forth in claim 7, further comprising a second door connected to said body proximate said second end.

10. A method of packaging a plurality of mailboxes, comprising the steps of:

providing each mailbox with:

a body having a pair of spaced side walls, a top connected to said side walls, and a bottom panel connected to said side walls opposite said top, said body having an open first end circumscribing a first surface area and a second end circumscribing a second surface area;

said body being tapered from said first end to said second end such that said first surface area is larger than said second surface area;

each of said mailboxes carries a flag rotatably mounted thereon;

each of said mailboxes carries a door hingedly mounted thereto proximate said first end;

forming a nested arrangement of mailboxes by opening the door of each mailbox except for a mailbox into which no other mailbox is to be nested, such that each door is positioned downwardly and forwardly and positioning the second end of one mailbox into the first end of another mailbox and positioning each mailbox such that the flag of a mailbox nested within another mailbox overlaps the flag of said another mailbox; and placing said nested arrangement of mailboxes in a container.

11. The method set forth in claim 10, wherein:

said mailbox has a plurality of rail elements connected to said bottom panel.

12. A nestable mailbox comprising:

a body having a pair of spaced side walls, a top connected to said side walls, and a bottom panel connected to said side walls opposite said top, said body having a first end circumscribing a first surface area and a second end circumscribing a second surface area, and a plurality of rail elements connected to said bottom panel;

each of said plurality of rail elements having a hollow interior forming a channel on the interior of said body and extending a substanital length of said body from said first end to said second end;

said body being tapered from said first end to said second end such that said first surface area is larger than said second surface area and said distance between said first end and said second end is greater than the width of said first surface area;

a first flared section having a front face, said first flared section extending around said side walls and said top, whereby said front face of said first flared section defines said first end of said body;

a plurality of apertures formed in said first flared section for attaching a door thereto; and whereby said second end can be received in another mailbox constructed substantially identically to said nestable mailbox.

13. The nestable mailbox set forth in claim 12, wherein said body further comprises:

a second flared section extending around said side walls and said top, said second flared section positioned rearwardly of said first flared section and forming a raised shoulder with respect to said top.

14. The nestable mailbox set forth in claim 13, wherein said second flared section touches said first flared section.

15. The nestable mailbox set forth in claim 13, further comprising a band of scalloped sections formed into at least one of said side walls.

16. The nestable mailbox set forth in claim 12, wherein:

both said first end and said second end have dimensions of height and width; and said first end has a larger height and a larger width than the height and width of said second end.

17. The nestable mailbox set forth in claim 12, wherein said body is made from polypropylene.

18. The nestable mailbox set forth in claim 12, further comprising a first door mounted to said body proximate said first end.

19. The nestable mailbox set forth in claim 18, wherein:

said first flared section extends downwardly to form an ear portion; and said first door is hingedly mounted to said ear portion.

20. The nestable mailbox set forth in claim 18, further comprising a second door mounted to said body proximate said second end.

* * * * *